United States Patent [19]

van Herpen

[11] Patent Number: 4,592,176

[45] Date of Patent: Jun. 3, 1986

[54] ROOF EDGING SYSTEM

[75] Inventor: Frederik C. van Herpen, RR Burgh-Haamstede, Netherlands

[73] Assignee: Alprokon Promotie en Ontwikkeling B.V., Netherlands

[21] Appl. No.: 633,333

[22] Filed: Jul. 23, 1984

[30] Foreign Application Priority Data

Jul. 26, 1983 [NL] Netherlands ..... 8302645

[51] Int. Cl.[4] ..... E04D 13/15

[52] U.S. Cl. ..... 52/96

[58] Field of Search ..... 52/58-62, 52/94, 96

[56] References Cited

U.S. PATENT DOCUMENTS

| | | | |
|---|---|---|---|
| 3,086,324 | 4/1963 | Cheney | 52/58 |
| 3,404,495 | 10/1968 | Simpson | 52/58 |
| 3,415,020 | 12/1968 | Windle | 52/58 |
| 3,444,658 | 5/1969 | Gobel | 52/60 |
| 3,533,201 | 10/1970 | Tyler | 52/60 |
| 4,241,549 | 12/1980 | Hall et al. | 52/60 |

FOREIGN PATENT DOCUMENTS

| | | | |
|---|---|---|---|
| 937021 | 11/1973 | Canada | 52/62 |

*Primary Examiner*—James L. Ridgill, Jr.

*Attorney, Agent, or Firm*—Ostrolenk, Faber, Gerb & Soffen

[57] ABSTRACT

Roof edging section system with a first section of which a rib rests upon the layers of roof covering material and a staggered second section carried by the first section and covering the rib with a cover strip.

5 Claims, 1 Drawing Figure

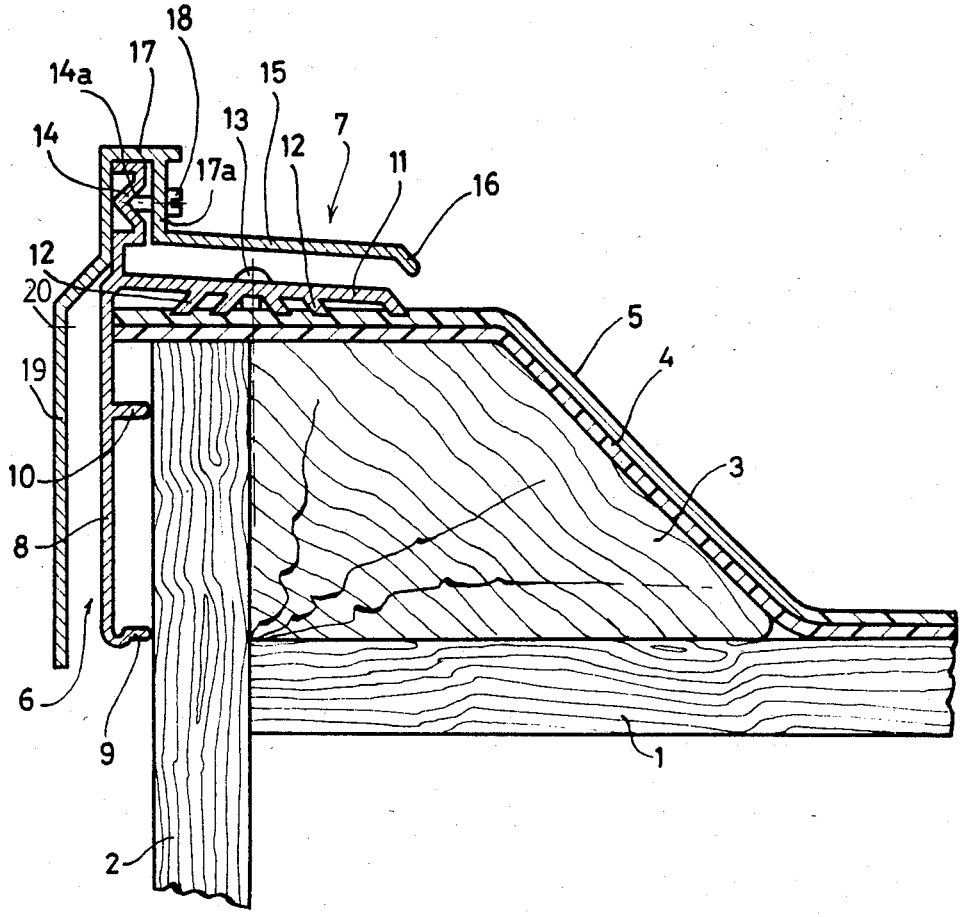
18
17
14a
15
13
7
14
12
11
17a
16
12
20
5
4
19
3
10
8
6
9
1
2

ROOF EDGING SYSTEM

BACKGROUND OF THE INVENTION

The invention relates to a roof edging system comprising a first section provided with a web portion to be fastened parallel to the vertical roof edge and a first rib extending transversely thereto.

Roof edging systems of the above kind are known in itself and are used for finishing the edges of a flat roof covered by a first layer of roof covering material, which also covers the gravel stop with thereon a second layer of this material which reaches halfway to the gravel stop. According to the prior art the section rests on the gravel stop and a flexible strip of web material which is then adhered to the first rib of the section and the covering layer.

The abovementioned way of finishing has many drawbacks. As a result of the great thermal expansion of the aluminum section a space of several milimeters must be preserved between two adjacent sections which must be bridged by the web material that is glued with a bitumen compound to the aluminum sections. This is, however, a time consuming and difficult operation--which can only be effected under favorable weather conditions-as a good interconnection must be made between two materials with quite different coefficients of expansion and said connection must be retained at temperatures which vary from minus 20° C. to +30° c. When the adherence is lost—which mostly happens unnoticed—moisture penetrates between the layers of roof covering with destructive consequences when the frost sets in: the layers of roof covering become loose and a strong wind can blow them away. The necessary space between two adjacent section parts frequently results into rupture of the roof covering; moisture which is blown along the section results into moisture stains on the brickwork, discoloring and the growth of moss.

Although the above way of finishing roofs is used extensively the problems therewith are so serious that an improvement is badly needed.

The invention offers such an improvement in the roof edging system. According to the invention the first rib therefore rests upon the roof covering layer and the section supports a second, easily dismountable and staggered section which has a cover strip laying above the first rib.

According to the invention the function of the separate strip of web material, is taken over by the cover strip of the second section. The layers of roof covering are pressed watertight against the underground by the rib of the first section and are also protected against damaging thereby; penetration of moisture is prevented by the cover strip which lies thereabove.

There is not only an important saving of costs—the investment is made only once—but another advantage is that directly after two adjacent sections have been put into place they can be covered by a second section so that the roof covering has its watertight finish.

An easy fastening of the second section on the first is obtained when the first section is provided with an upstanding rib disposed substantially in line with the web portion and the second section is provided with a U-shaped rib surrounding the firstmentioned rib. Preferably the upstanding rib is of M-shaped section and the first section is fastened on the second section with the aid of a screw passing through the first section and fitting into the depression of the M-shaped rib.

This novel roof edging section has the advantage that leakage of water, which occurs in the known system along the web-like material under the influence of the wind is not possible and that the edge of the roof has an attractive exterior, the more because the second section can in principle be made from any suitable metal in any suitable color and shape (for instance eloxated extruded aluminum or stainless steel). Furthermore the system is easily removable, for instance, for inspection or other use.

Penetration of rain water until the front edge of the roof is minimal so that there are no vertical dirt stripes.

It is observed that a roof edging system with a removable cover strip is known in itself from the German Offenlegungsschrift No. 1.659.341. In this known structure the layer of roof covering is only covered by the removable strip which is made by a number of sections with spaces in between through which water can penetrate to behind the strip with all consequences thereof. Furthermore this structure uses complicated profiles which are difficult to mount.

From the German Offenlegungsschrift No. 1.609.913 is known a roof edging system with a pressure rib resting upon the layer of roof covering and thereabove a cover strip which covers this pressure rib only partially and carries screws acting upon the rib. Here, too, there are spaces between the various sections through which water can penetrate into the covering layers.

Finally the Dutch patent application No. 65.08538 describes a roof edging system in which mounting brackets carried by the roof support a profile with a part covering the front edge of the roof and a part lying above the roof with thereunder a clamping strip pressing upon the layers of roof covering. Removal of the profile has as result that the entire covering system falls apart so that it is not possible to mount this sytem in two phases or to remove the covering strip for inspection or exchange. Furthermore fitting the profile makes it necessary to act upon the screws which lie at a front edge of the building and are difficult to reach.

SURVEY OF THE DRAWING

The drawing shows in cross-section a part of a roof with the roof edging according to the invention.

DESCRIPTION OF A PREFERRED EMBODIMENT

In the drawing, the reference numeral 1 designates the roof, the reference numeral 2 designates the outside wall thereof, and the reference numeral 3 designates the usual gravel stop. On the roof 1 lies the first roof covering layer 4 and on the latter, the second roof covering layer 5; both layers extend to the front of the front edge 2.

The roof edging system according to the invention consists of a first section, indicated as a whole by the reference numeral 6, and a second section indicated as a whole by the reference numeral 7. The first section 6 has a web portion 8 with the bent-over portion 9 and a short rib 10 extending transversely relative to the web, so that in the installed portion the whole member is supported against the front edge 2; ventilation or drainage openins may optionally be provided in the transverse ribs 9 and 10. In addition, the section 6 has the large transverse rib 11, which is at an angle somewhat smaller than 90° to the web part 8 and is provided with short transverse ribs 12. The roof covering 4, 5 is clamped securely between the upper face of the gravel stop 3 and the front edge 2 on the one hand, and this transverse rib 11 on the other hand; by means of screws 13 passing through the transverse rib 11 the section 6 is fastened on the roof.

When the section members are installed, spaces permitting unavoidable thermal expansion must be left between portions of section laid in line with one another. In order to prevent moisture from penetrating between the roof coverings 4 and 5 via these spaces, in the system according to the invention the second section 7 is fitted. This section is carried by the section 6, and for that purpose the latter is provided, in line with the web portion 8, with a short M-shaped rib 14. The second section 7 consists of a cover strip 15 ending at the front in a downwardly extending front edge 16 and continued at the other end by a U-shaped part 17 which fits around the M-shaped part 14; the outermost leg of the U-shaped part 17 is extended by a downwardly directed cover edge 19. The sections are staggered with respect to each other so that an opening between two adjacent sections 6 is always covered by the cover strip 15.

The section 7 is fastened on the section 6 by means of clamp screws 18, which are screwed through the leg 17*a* of the U-shaped part 17 and bear against the depression 14*a* in the M-shaped part 14.

The installation of the above described roof edging section system is extremely simple: after the two layers of roof covering 4 and 5 have been fitted, the section lengths 6 are placed in position and fastened by means of the screws 13; thereupon, the section 7 has simply to be placed in position and fastened by turning the screws 18. The section can without difficulty be removed for inspection or repair, and the section can also be used again.

The figure shows an embodiment in which the cover edge 19 extends past the end edge 9, and thus forms the exterior of the roof section; an embodiment is obviously also possible in which the edge ends at a higher point, for example at the point 20.

What is claimed is:

1. Roof edging section system comprising a first section provided with a web portion to be fastened parallel to the vertical roof edge and a first rib extending transversely thereto, in which the first rib rests upon the roof covering layer and the section supports a second, easily dismountable and staggered second section, which has a cover strip laying above the first rib.

2. Roof edging section system according to claim 1, in which the first section is provided with an upstanding rib of M-shaped configuration disposed substantially in line with the web portion and with the point of the recessed part of the M directed away from the roof edge, the second section being provided with a U-shaped rib surrounding the first mentioned rib and the first section being fastened on the second section by means of a screw passing through the second section and fitting into the depression of the M-shaped rib.

3. Roof edging section system according to claim 1, in which the first section is provided with an upstanding rib disposed substantially in line with the web portion and the second section is provided with a U-shaped rib surrounding the firstmentioned rib.

4. Roof edging system according to claim 3, in which the upstanding rib is of M-shaped section the first section being fastened on the second section with the aid of a screw passing through the first section and fitting into the depression in the M-shaped rib.

5. Roof edging section system according to claim 2, in which the U-shaped rib of the second section is extended to form a cover strip lying in front of the web portion of the first section.

* * * * *